US006592211B2

(12) United States Patent
Swenson

(10) Patent No.: US 6,592,211 B2
(45) Date of Patent: Jul. 15, 2003

(54) ELECTROSTATIC MECHANISM FOR INKJET PRINTERS RESULTING IN IMPROVED IMAGE QUALITY

(75) Inventor: Samual K Swenson, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/981,093

(22) Filed: Oct. 17, 2001

(65) Prior Publication Data

US 2003/0071879 A1 Apr. 17, 2003

(51) Int. Cl.[7] ..... B41J 2/01
(52) U.S. Cl. ..... 347/74; 347/75
(58) Field of Search ..... 347/73, 74, 75, 347/76, 77, 79, 82, 83

(56) References Cited

U.S. PATENT DOCUMENTS 4,148,718 A * 4/1979 Fulwyler ..... 209/3.1
4,350,986 A * 9/1982 Yamada ..... 347/75
5,337,071 A * 8/1994 East et al. ..... 347/77
6,357,866 B1 * 3/2002 Van Rensburg ..... 347/75

* cited by examiner

*Primary Examiner*—Anh T. N. Vo

(57) ABSTRACT

Using an electrostatic mechanism for inkjet printers to improve image quality is disclosed. A carriage assembly for such a printer includes one or more inkjet print heads, and an electrostatic mechanism. Each inkjet print head ejects ink from a corresponding ink supply in droplets as needed and aimed on a media. The droplets each have either an improper drop size or a proper drop size. The proper drop size is greater than a first threshold, whereas the improper drop size is less than a second threshold that is itself less than the first threshold. The electrostatic mechanism prevents droplets of the improper drop size from reaching the media. The mechanism has an electrostatic charge sufficiently great to affect the droplets having the improper drop size, without substantially affecting the droplets having the proper drop size.

20 Claims, 7 Drawing Sheets

ELECTROSTATIC MECHANISM FOR INKJET PRINTERS RESULTING IN IMPROVED IMAGE QUALITY

FIELD OF THE INVENTION

This invention relates generally to inkjet printers, and more particularly to unwanted ink aerosol emitted by such printers that can negatively affect image quality.

BACKGROUND OF THE INVENTION

Inkjet printers have become increasingly inexpensive and increasingly popular. A typical inkjet printer usually has a number of common components, regardless of its brand, speed, and so on. There is a print head that contains a series of nozzles used to spray drops of ink onto paper. Ink cartridges, either integrated into the print head or separate therefrom, supply the ink. There may be separate black and color cartridges, color and black in a single cartridge, a cartridge for each ink color, or a combination of different colored inks in a given cartridge. A print head motor typically moves the print head assembly back and forth horizontally, or laterally, across the paper, where a belt or cable is used to attach the assembly to the motor. Other types of printer technologies use either a drum that spins the paper around, or mechanisms that move the paper rather than the print head. The result is the same, in that the print head is effectively swept across the paper linearly to deposit ink on the paper. Rollers pull paper from a tray, feeder, or the user's manual input, and advance the paper to new vertical locations on the paper.

In general, there are two broad classes of inkjet printers: continuous-ink inkjet printers, and drop-on-demand inkjet printers. The earliest inkjet printers were continuous-ink printers. With this type of inkjet printer, a continuous stream of ink droplets is sprayed. Deflection plates are used to cause the ink to either reach the media, or drop in a return gutter. The inkjet nozzle typically uses a piezoelectric crystal to synchronize the droplets, and a charging tunnel selectively charges the drops that are deflected into the return gutter. Other droplets reach the media. Most inkjet printers today, however, use the drop-on-demand approach, which forces a drop of ink out of a chamber by heat or electricity. The thermal method is used by some manufacturers, in which a resistor is heated that forces a droplet of ink out of the nozzle by creating an air bubble in the ink chamber. By comparison, the electric approach employed by other manufacturers uses a piezoelectric element that charges crystals that expand and jet the ink onto the media.

A problem with at least some drop-on-demand inkjet printers is the presence of image-quality impairing aerosol. When a print head of the inkjet printer ejects the ink droplets from the nozzle, ideally they form a single drop that travels to the media. However, occasionally the emitting drops break up before they reach the media. These droplets are usually between two-to-three picaliters in size, as compared to the twelve picaliters in size of the desired, unbroken droplets. The smaller droplets stay suspended in air for a short duration of time, creating a mist or aerosol of ink between the media and the print head and/or the carriage assembly. This aerosol can cause image-quality defects and print artifacts on the media, and may cause the printer to malfunction. The result is a less-than-ideal printed image on the media, and potentially an improperly functioning printer. For these and other reasons, therefore, there is a need for the present invention.

SUMMARY OF THE INVENTION

The invention relates to using an electrostatic mechanism to improve image quality. A carriage assembly of the invention for such a printer includes one or more inkjet print heads, and an electrostatic mechanism. Each inkjet print head ejects ink from a corresponding ink supply in droplets as needed and aimed on a media. The droplets each have either an improper drop size or a proper drop size. The proper drop size is greater than a first threshold, whereas the improper drop size is less than a second threshold that is itself less than the first threshold. The electrostatic mechanism prevents droplets of the improper drop size from reaching the media. The mechanism has an electrostatic charge sufficiently great to affect the droplets having the improper drop size, without substantially affecting the droplets having the proper drop size.

An inkjet printer of the invention includes one or more ink supplies, one or more inkjet print heads, and an electrostatic mechanism. Each inkjet print head ejects ink from a corresponding ink supply or supplies as needed and aimed on a media. The ink is ejected in substantially properly sized droplets, while also at least occasionally ejected as an image quality-impairing aerosol. The electrostatic mechanism prevents the image quality-impairing aerosol from reaching the media without affecting the substantially properly sized droplets of ink.

A method of the invention includes ejecting substantially properly sized droplets of ink as aimed on a media. Concurrently, the method ejects undesired aerosol-sized droplets of ink substantially smaller than the substantially properly sized droplets of ink. The method electrostatically affects the undesired aerosol-sized droplets of ink to prevent them from reaching the media, while unaffecting the substantially properly sized droplets of ink.

The invention provides for advantages over the prior art. Significantly, image quality is improved because the aerosol-sized droplets of ink do not reach the media. Rather, their direction is changed electrostatically, causing them to be deposited in a collector, such as a tray or an absorbent material. As a result, the potential for printer malfunctioning due to such undesired ink aerosol is reduced. Still other advantages, aspects, and embodiments of the invention will become apparent by reading the detailed description that follows, and by referencing the accompanying drawings.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. For example, whereas the invention is substantially described in relation to a drop-on-demand inkjet printer, it is also applicable to other types of inkjet printers, such as continuous-ink inkjet printers, and so on. The following detailed description is, therefore, not to be taken in a limiting sense, and the scope of the present invention is defined only by the appended claims.

Image Quality-Impairing Ink Aerosol

Figure 1A:
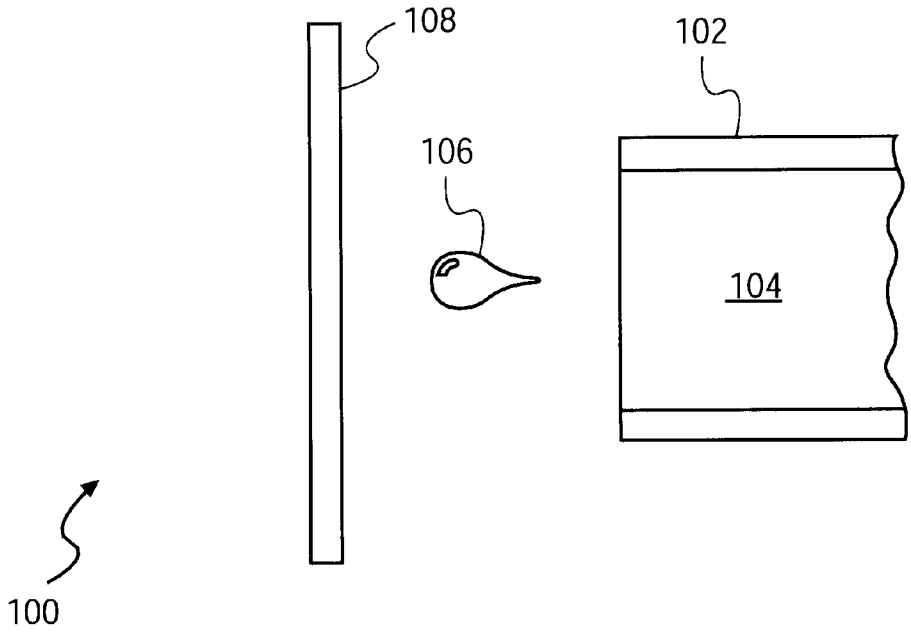
FIGS. 1A and 1B are side-view diagrams showing the jetting of a properly sized inkjet droplet and the jetting of improperly sized inkjet droplets, respectively, the latter which can degrade image quality and potentially cause printer malfunction.

FIG. 1A shows a side view of the desired scenario 100 in which no image quality-impairing ink aerosol is ejected by the print head 102. The print head 102 may more specifically be an inkjet nozzle, and contains a supply of ink 104. The print head 102 ejects a properly sized droplet of ink 106 aimed against a media 108, such as paper or another type of media. The droplet of ink 106 is ejected as needed. That is, the droplet of ink 106 is part of a drop-on-demand inkjet printing technique, as opposed to a continuous-ink inkjet printing technique. The droplet of ink 106 has a proper drop size greater than a first threshold, and preferably has a size of substantially twelve picaliters. Although only one droplet of ink 106 is shown for illustrative clarity, in practice a much larger number of such droplets are ejected by the print head 102.

Figure 1B:
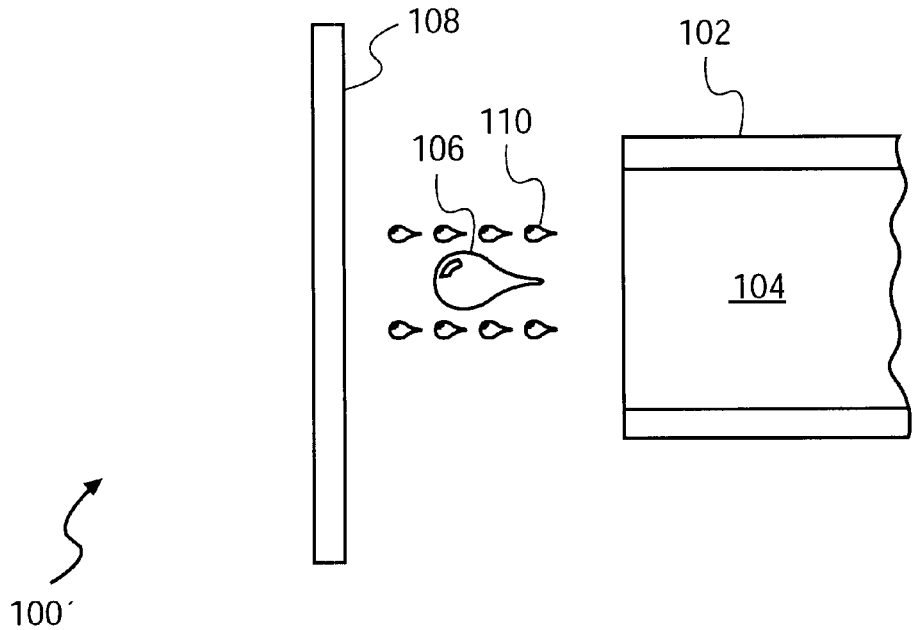

FIG. 1B shows a side view of the undesired scenario 100 in which image quality-impairing ink aerosol is also ejected by the print head 102. While ejecting the properly sized droplet of ink 106, the print head 102 also ejects this aerosol from the supply of ink 104. The aerosol is made up of a number of small droplets, such as the droplet of ink 110. The droplet 110 has an improper size less than a second threshold that is less than the first threshold, and may have a size of substantially two-to-three picaliters. The aerosol may also be aimed against the media 108, and as such can cause image quality defects on the image being printed on the media 108. Furthermore, the aerosol may land on the print head 102 or other components of the inkjet printer of which the print head 102 is a part, potentially causing the printer to malfunction.

Electrostatically Affecting the Aerosol

Figure 2A:
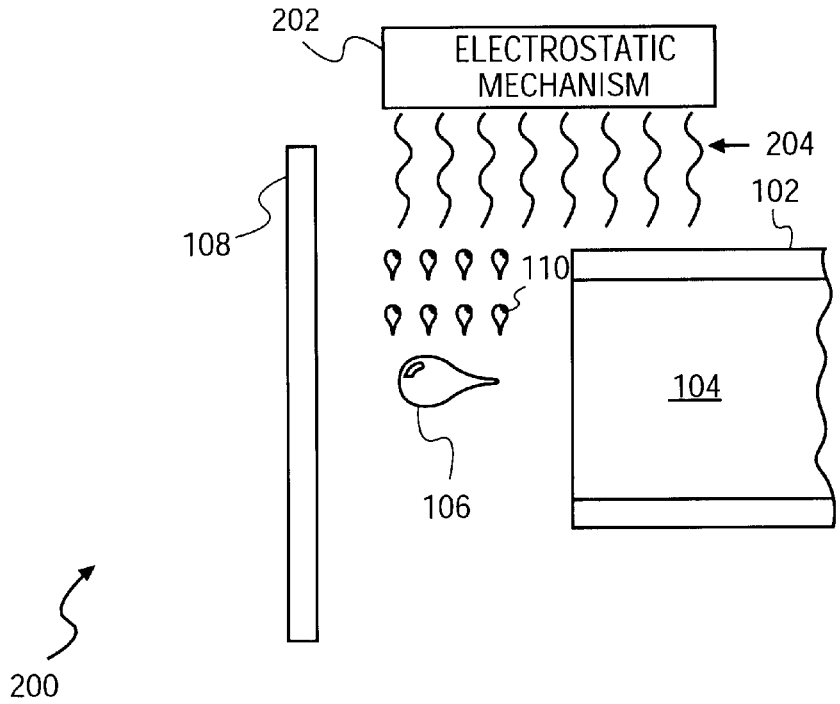
FIGS. 2A and 2B are side-view diagrams showing embodiments of the invention electrostatically attract and repel, respectively, the improperly sized inkjet droplets, without affecting the properly sized inkjet droplet, to prevent the former droplets from degrading image quality or potentially causing printer malfunction.

FIG. 2A shows a side view of a first scenario 200 by which an embodiment of the invention prevents the aerosol-sized droplets of ink undesirably ejected by the print head 102 from reaching the media 108, or otherwise from landing on the components of the printer of which the print head 102 is a part. From the supply of ink 104, the print head 102 again ejects, as needed, a properly sized and desired droplet of ink 106 aimed against the media 108. In so ejecting this droplet of ink 106, the print head 102 also ejects an ink aerosol of smaller sized droplets of ink, such as the droplet of ink 110.

The ink 106 and the ink aerosol, such as the droplet of ink 110, are inherently charged upon ejection from the print head 102. Alternatively, the ink 106 and the ink aerosol, such as the droplet of ink 110, may instead be expressly charged by a charging mechanism not shown in FIG. 2A. Both such scenarios are encompassed by the invention.

An electrostatic mechanism 202 emits an electrostatic charge, as indicated by the lines 204 emanating from the mechanism 202. The electrostatic charge in the embodiment of FIG. 2A attracts the aerosol-sized droplets, such as the droplet 110, causing them to change direction, without affecting the properly sized droplet 106. The electrostatic charge is opposite to that of the charge of the ink 106 and the ink aerosol, such as the droplet 110, for purposes of attraction. The electrostatic charge is sufficiently great to attract or otherwise affect the direction of the aerosol-sized droplets, but not so great as to attract or otherwise affect the direction of the droplet 106. The charge prevents the aerosol from reaching the media 108 and otherwise prevents the aerosol from affecting the functioning of the inkjet printer of which the print head 102 is a part.

Figure 2B:
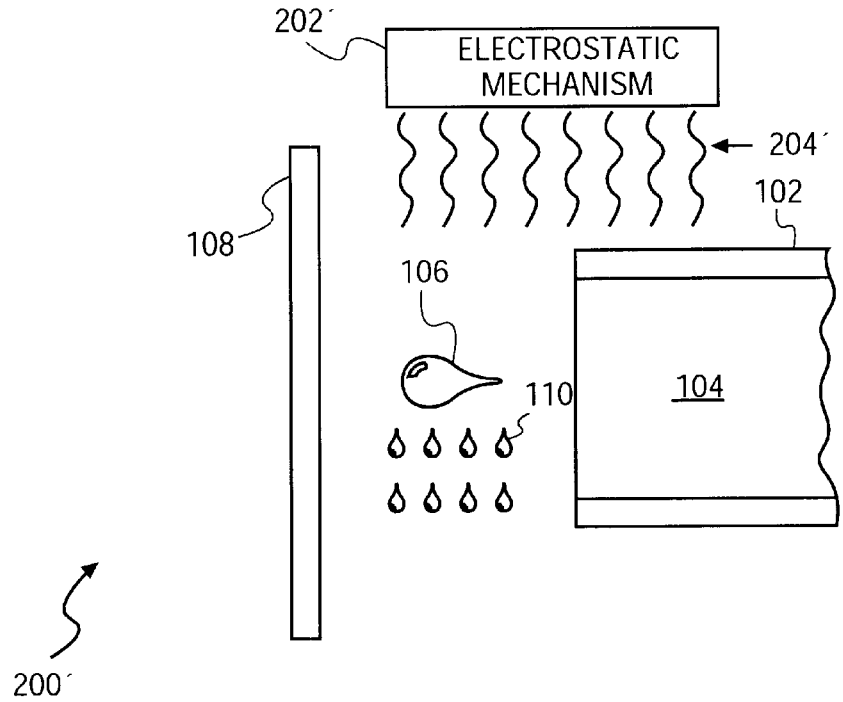

FIG. 2B shows a side view of a second scenario 200' by which another embodiment of the invention prevents the aerosol-sized droplets of ink undesirably ejected by the print head 102 from reaching the media 108, or otherwise from landing on the components of the printer of which the print head 102 is a part. From the supply of ink 104, the print head 102 as before ejects, as needed, a properly sized and desired droplet of ink 106 aimed against the media 108. In so ejecting the droplet of ink 106, the print head 102 also ejects an ink aerosol of smaller sized droplets of ink, such as the droplet of ink 110.

As in FIG. 2A, the ink 106 and the ink aerosol in FIG. 2B, such as the droplet of ink 110, are inherently charged upon ejection from the print head 102. Alternatively, the ink 106 and the ink aerosol, such as the droplet of ink 110, may instead be expressly charged by a charging mechanism not shown in FIG. 2A. Both such scenarios are encompassed by the invention.

An electrostatic mechanism 202 again emits an electrostatic charge, as indicated in FIG. 2B by the line 204' emanating from the mechanism 202. The electrostatic charge in the embodiment of FIG. 2B repels the aerosol-sized droplets, such as the droplet 110, causing them to change direction, without affecting the properly sized droplet 106. The electrostatic charge is the same as that of the charge of the ink 106 and the ink aerosol, such as the droplet 110, for purposes of repelling the ink aerosol. The electrostatic charge is sufficiently great to repel or otherwise affect the direction of the aerosol-sized droplets, but not so great as to repel or otherwise affect the direction of the droplet 106. The charge prevents the aerosol from reaching the media 108 and otherwise prevents the aerosol from affecting the functioning of the inkjet printer of which the print head 102 is a part.

Figure 3A:
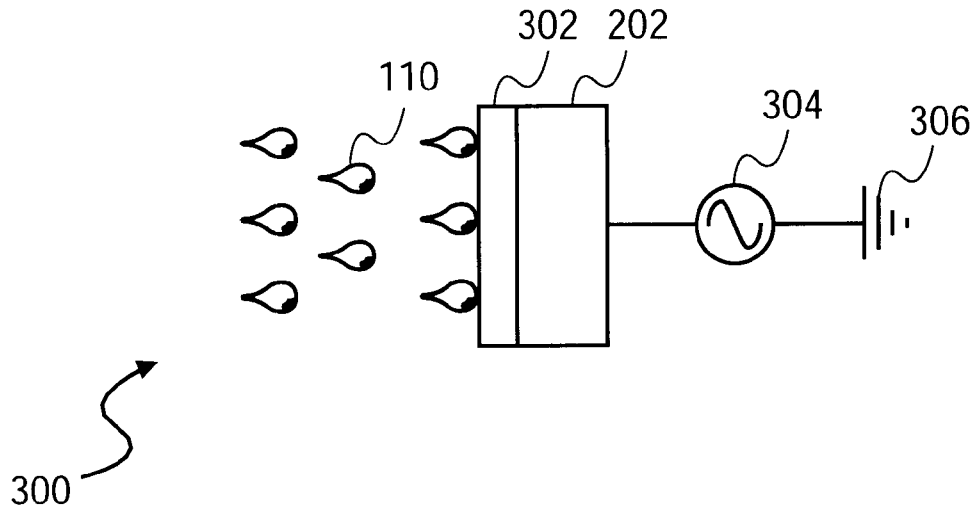
FIGS. 3A and 3B are top-view diagrams showing the improperly sized inkjet droplet attraction of FIG. 2A, in which the droplets are absorbed by an absorbent material and are collected by a tray, respectively, according to differing embodiments of the invention.
Figure 3B:
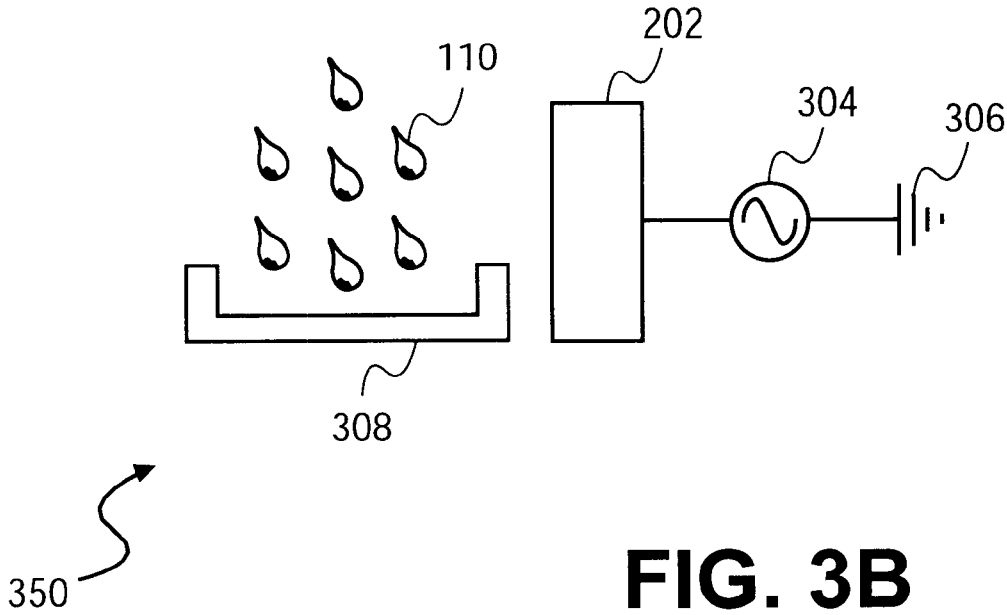

FIGS. 3A and 3B show top views of how the scenario 200 of FIG. 2A can be specifically implemented according to differing embodiments of the invention. The properly sized droplet of ink 106 and the lines 204 are not shown in FIGS. 3A and 3B for illustrative clarity. In FIG. 3A, indicated as the scenario 300, an absorbent material 302 is placed over the electrostatic mechanism 202, such that the mechanism 202 emits the electrostatic charge from behind the absorbent material 302. The aerosol, such as the droplet 110, is attracted to the mechanism 202, and is absorbed by the absorbent material 302. An electrostatic power source 304 is specifically indicated in FIG. 3A as the manner by which the electrostatic mechanism 202 receives power to emit its attracting electrostatic charge. The power source 304 is connected between ground 306 and the mechanism 202.

In FIG. 3B, indicated as the scenario 350, a tray 308 is used in lieu of the absorbent material 302. The tray 308 is placed near the electrostatic mechanism 202. As the aerosol, such as the droplet 110, is attracted to the mechanism 202, it drops into the tray 308. As in FIG. 3A, there is an electrostatic power source 304 in FIG. 3B that provides the electrostatic mechanism 202 with power to emit its attracting electrostatic charge. The power source 304 is again connected between ground 306 and the mechanism 202. The absorbent material 302 of FIG. 3A and the tray 308 of FIG. 3B are more generally referred to as collectors.

Figure 4A:
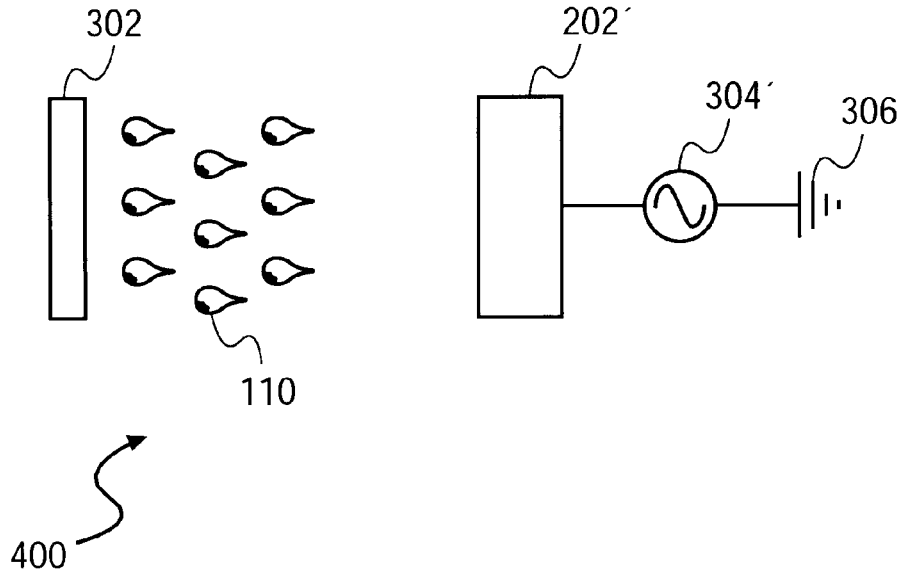
FIGS. 4A and 4B are top-view diagrams showing the improperly sized inkjet droplet repelling of FIG. 2B, in which the droplets are absorbed by an absorbent material and are collected by a tray, respectively, according to differing embodiments of the invention.
Figure 4B:
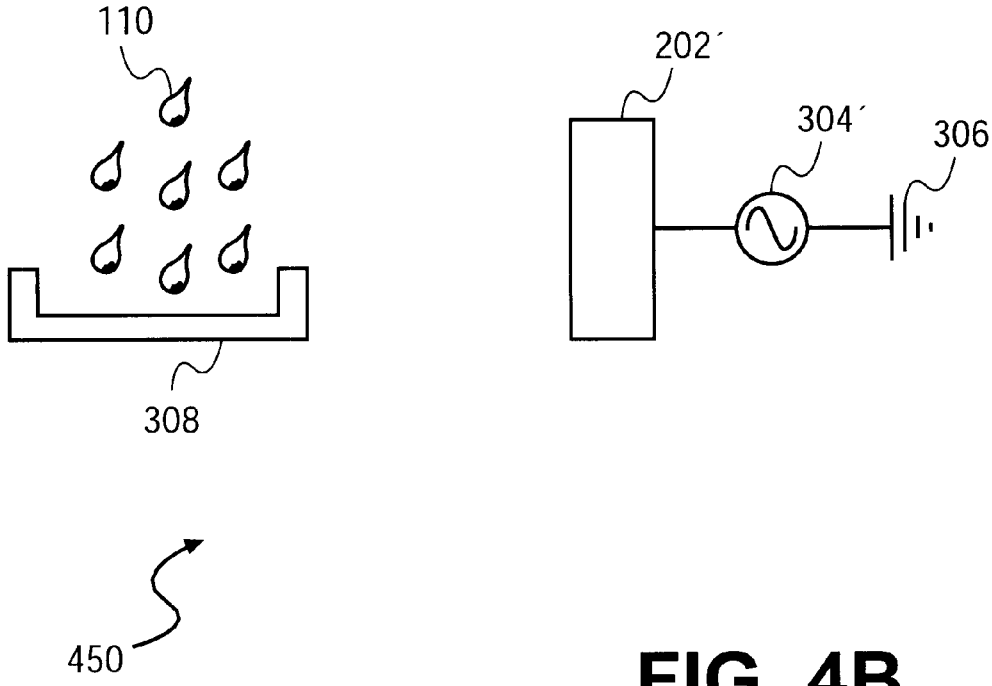

FIGS. 4A and 4B show top views of how the scenario 200' of FIG. 2B can be specifically implemented according to differing embodiments of the invention. The properly sized droplet of ink 106 and the lines 204 are not shown in FIGS. 4A and 4B for illustrative clarity. In FIG. 4A, indicated as the scenario 400, an absorbent material 302 is positioned away from and opposite to the electrostatic mechanism 202'. The aerosol, such as the droplet 110, is repelled from the mechanism 202', and is absorbed by the absorbent material 302. An electrostatic power source 304' is specifically indicated in FIG. 4A as the manner by which the electrostatic mechanism 202' receives power to emit its repelling electrostatic charge. The power source 304' is connected between ground 306 and the mechanism 202'.

In FIG. 4B, indicated as the scenario 450, a tray 308 is used in lieu of the absorbent material 302. The tray 308 is placed away from and opposite to the electrostatic mechanism 202'. As the aerosol, such as the droplet 110, is repelled by the mechanism 202', it drops into the tray 308. As in FIG. 4A, there is an electrostatic power source 304' in FIG. 4B that provides the electrostatic mechanism 202' with power to emit its repelling electrostatic charge. The power source 304' is again connected between ground 306 and the mechanism 202.

Inkjet Printer Carriage Assembly and Inkjet Printer

Figure 5:
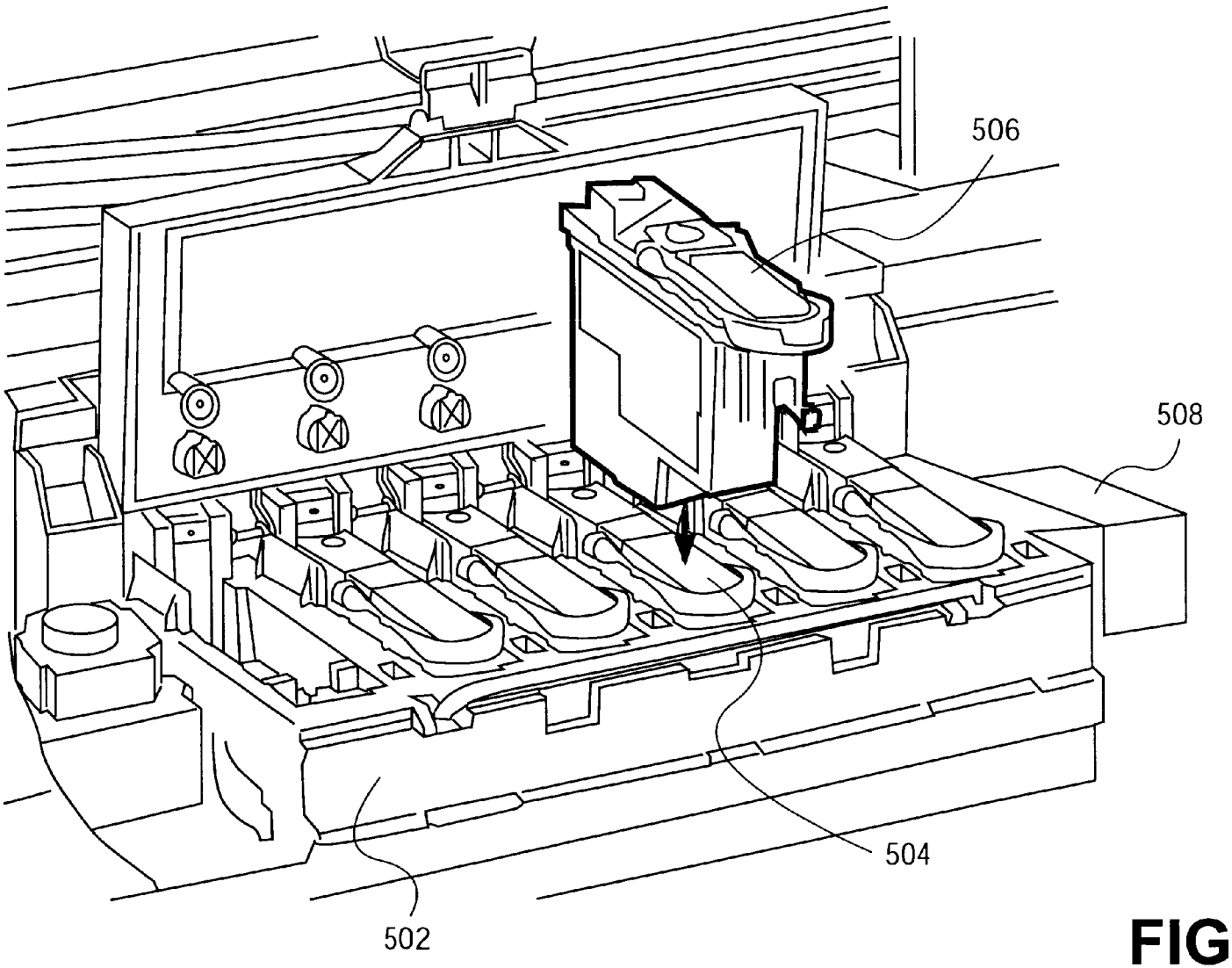
FIG. 5 is a diagram showing an example inkjet printer carriage assembly including an electrostatic mechanism, according to an embodiment of the invention.

FIG. 5 shows an example drop-on-demand inkjet printer carriage assembly 502 in conjunction with which embodiments of the invention may be implemented. The carriage assembly 502 includes a number of slots, such as the slot 504, into which print heads for the variously different ink colors to be inserted, such as the print head 506. The electrostatic mechanism 508 is positioned to one side of the assembly 502. The mechanism 502 may be implemented as the electrostatic mechanism 202 of FIGS. 2A, 3A, and 3B or the electrostatic mechanism 202' of FIGS. 2B, 4A, and 4B, according to different embodiments of the invention.

Figure 6:
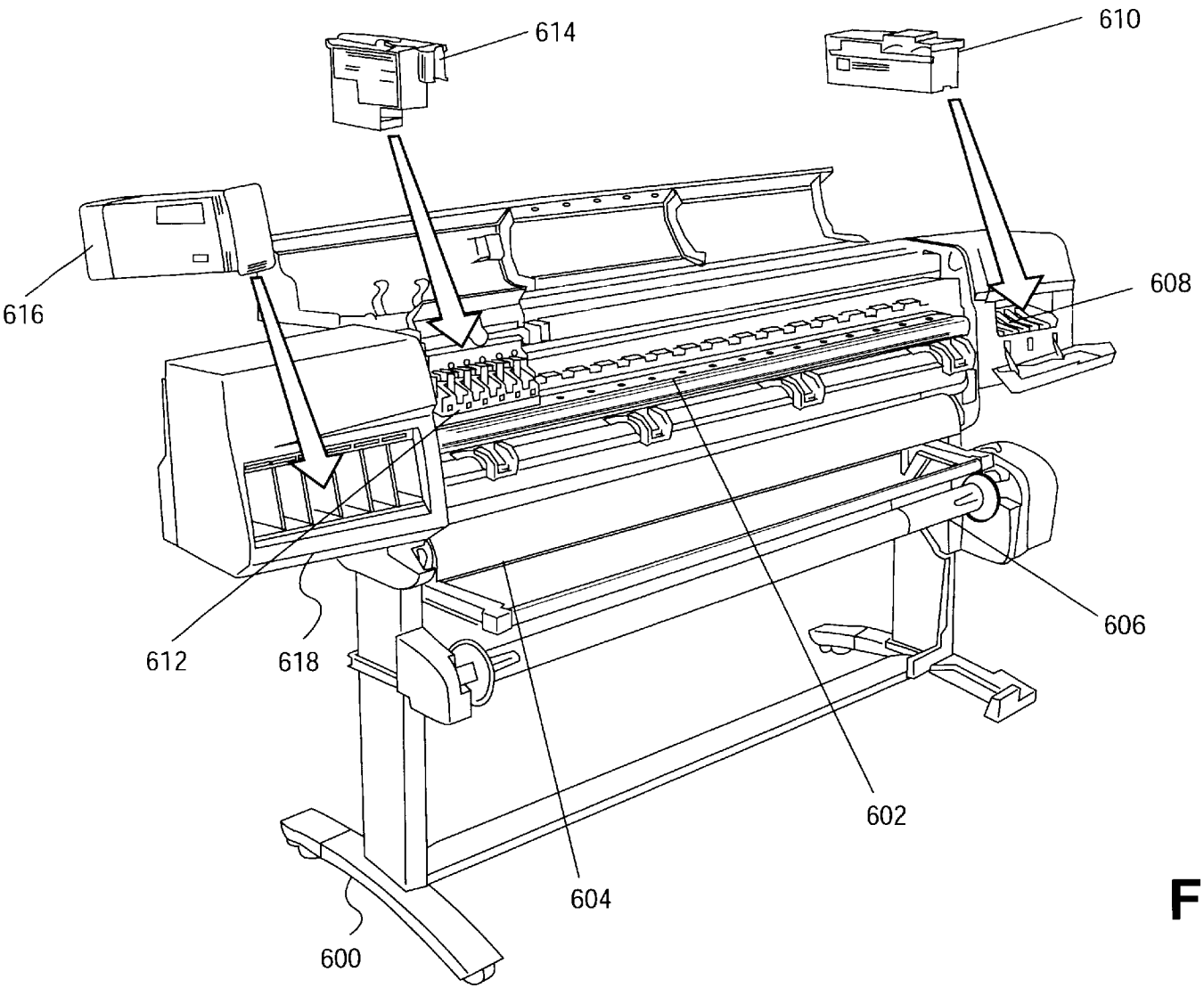
FIG. 6 is a diagram showing an example inkjet printer in which the carriage assembly of FIG. 5, including the electrostatic mechanism, can be used, according to an embodiment of the invention.

FIG. 6 shows an example wide-format drop-on-demand inkjet printer 600 in conjunction with which embodiments of the invention may be implemented. Other, smaller-format drop-on-demand inkjet printers, such as those more typically found in home and office environments, may also be implemented in conjunction with embodiments of the invention. The printer 600 includes a platen 602, a media roll 604, and a take-up roll 606 for the media. A service station 608 is situated on one side of the printer 600 for insertion of a corresponding print head cleaner 610, which cleans the print heads.

A carriage assembly 612, which can be the carriage assembly 502 of FIG. 5, has inserted thereinto one or more print heads, such as the print head 614. Finally, ink cartridges, such as the ink cartridge 616, are inserted into the ink station 618. The assembly 612 moves horizontally to the station 618 for its print heads to obtain a supply of ink. In other types of drop-on-demand inkjet printers, the ink cartridges may be inserted into the carriage assembly 612 itself, in corresponding print heads. Furthermore, the ink cartridges may be integrated into the print heads themselves in such printers.

Method

Figure 7:
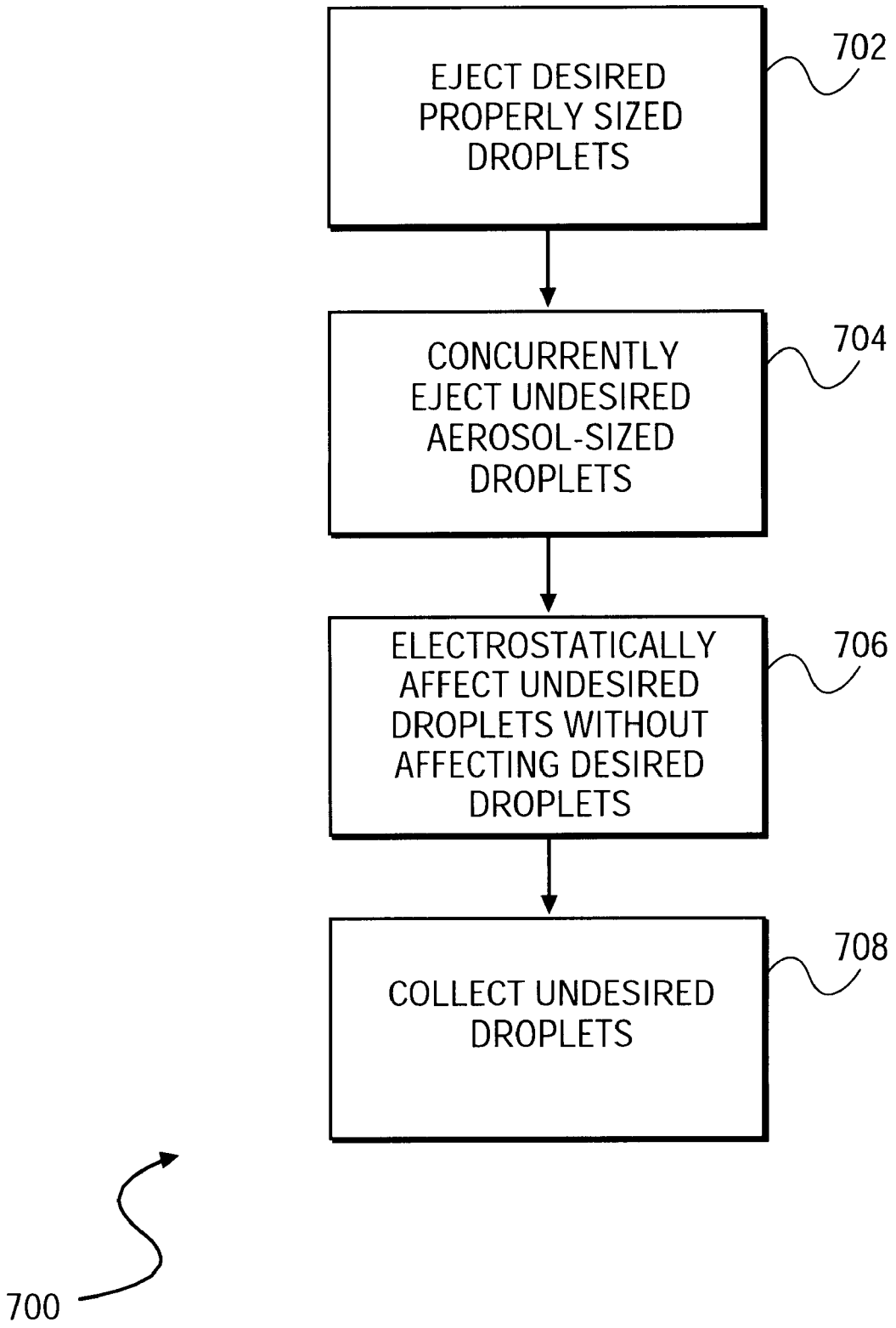
FIG. 7 is a flowchart of a method in which image quality-impairing ink aerosol is affected to prevent image quality degradation and potential printer malfunction, without affecting properly sized ink droplets, according to an embodiment of the invention.

FIG. 7 shows a method 700 according to an embodiment of the invention, which may be performed in conjunction with or by the inkjet printer 600 of FIG. 6 and the carriage assembly 502 of FIG. 5. First, substantially properly sized droplets of ink are ejected, on demand, as aimed against a media (702). Concurrently, at least occasionally undesired aerosol-sized droplets of ink are also ejected (704). The aerosol-sized droplets are substantially smaller than the substantially properly sized droplets of ink. The undesired aerosol-sized droplets of ink are electrostatically affected, without electrostatically affecting the desired substantially properly sized droplets of ink (706). For example, the undesired droplets may be electrostatically attracted or repelled, to prevent the droplets from reaching the media or otherwise affecting performance of the printer or its functioning. Finally, the aerosol-sized droplets of ink are collected (708). For example, an absorbent material may absorb the undesired droplets, or a tray may collect them.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. For example, whereas the invention is substantially described in relation to a drop-on-demand inkjet printer, it is also applicable to other types of inkjet printers, such as continuous-ink inkjet printers, and so on. Therefore, it is manifestly intended that this invention be limited only by the claims and equivalents thereof.

I claim:

1. A carriage assembly for an inkjet printer comprising:

one or more inkjet print heads, each inkjet print head ejecting ink from a corresponding ink supply in droplets as needed and aimed on a media, the droplets each having one of a proper drop size greater than a first threshold and an improper drop size less than a second threshold, the second threshold less than the first threshold; and, an electrostatic mechanism to prevent the droplets having the improper drop size from reaching the media, the mechanism having an electrostatic charge sufficiently great to affect the droplets having the improper drop size less than the second threshold without substantially affecting the droplets having the proper size greater than the first threshold.

2. The carriage assembly of claim 1, wherein the proper drop size is substantially twelve picaliters, and the improper drop size is substantially between two and three picaliters.

3. The carriage assembly of claim 1, wherein the electrostatic mechanism comprises an electrostatic power source to generate the electrostatic charge.

4. The carriage assembly of claim 1, wherein the electrostatic mechanism comprises a collector to collect the ink having the improper drop size.

5. The carriage assembly of claim 4, wherein the collector comprises one of an absorbent material and a tray.

6. The carriage assembly of claim 4, wherein the electrostatic charge of the mechanism is emitted in-line from behind the collector.

7. The carriage assembly of claim 1, wherein the electrostatic charge attracts the droplets having the improper drop size without attracting the droplets having the proper drop size.

8. The carriage assembly of claim 1, wherein the electrostatic charge repels the droplets having the improper drop size without repelling the droplets having the proper drop size.

9. An inkjet printer comprising:

one or more ink supplies;

one or more inkjet print heads, each inkjet print head ejecting ink from a corresponding at least one of the one or more ink supplies in ink droplets as needed and aimed on a media, the ink droplets having substantially properly sized droplets while also having at least occasionally improperly sized droplets as an image quality-impairing aerosol; and, an electrostatic mechanism to prevent the image quality-impairing aerosol from reaching the media without affecting the substantially properly sized droplets of ink.

10. The printer of claim 9, wherein the substantially properly sized droplets have a size of substantially twelve picaliters, and the image quality-impairing aerosol has droplets having a size of substantially between two and three picaliters.

11. The printer of claim 9, wherein the electrostatic mechanism emits an electrostatic charge sufficiently great to attract the image quality-impairing aerosol without attracting the substantially properly sized droplets.

12. The printer of claim 11, further comprising a tray situated over the electrostatic mechanism to collect the image quality-impairing aerosol attracted by the electrostatic mechanism.

13. The printer of claim 11, further comprising an absorbent material situated near the electrostatic mechanism to collect the image quality-impairing aerosol attracted by the electrostatic mechanism.

14. The printer of claim 9, wherein the electrostatic mechanism emits an electrostatic charge sufficiently great to repel the image quality-impairing aerosol without repelling the substantially properly sized droplets.

15. The printer of claim 14, further comprising a collector situated away from the electrostatic mechanism to collect the image quality-impairing aerosol repelled by the electrostatic mechanism.

16. The printer of claim 15, wherein the collector comprises one of a tray and an absorbent material.

17. A method comprising:

ejecting ink droplets from one ink jet printhead, the ink droplets having substantially properly sized droplets of ink as aimed on a media;

concurrently having undesired aerosol-sized droplets of ink substantially smaller than the substantially properly sized droplets of ink; and, electrostatically affecting the undesired aerosol-sized droplets of ink to prevent the undesired aerosol-sized droplets of ink from reaching the media, while unaffecting the substantially properly sized droplets of ink.

18. The method of claim 17, further comprising collecting the undesired aerosol-sized droplets of ink as electrostatically affected.

19. The method of claim 17, wherein electrostatically affecting the undesired aerosol-sized droplets of ink comprises electrostatically attracting the undesired aerosol-sized droplets of ink.

20. The method of claim 17, wherein electrostatically affecting the undesired aerosol-sized droplets of ink comprises electrostatically repelling the undesired aerosol-sized droplets of ink.

* * * * *